US007530570B2

(12) United States Patent
Nulph et al.

(10) Patent No.: US 7,530,570 B2
(45) Date of Patent: May 12, 2009

(54) LOTTERY TICKET GAME

(75) Inventors: James L. Nulph, San Antonio, TX (US); Rhonda S. Gillen, San Antonio, TX (US)

(73) Assignee: Oberthur Gaming Technologies, Inc., Montreal, Quebec (CA)

( * ) Notice: Subject to any disclaimer, the term of this patent is extended or adjusted under 35 U.S.C. 154(b) by 178 days.

(21) Appl. No.: 11/332,994

(22) Filed: Jan. 17, 2006

(65) Prior Publication Data

US 2007/0164511 A1 Jul. 19, 2007

(51) Int. Cl.
*A63F 3/06* (2006.01)
*A63F 1/00* (2006.01)

(52) U.S. Cl. ..... 273/139; 273/292; 283/901; 283/903

(58) Field of Classification Search ..... 273/139, 273/292; 283/901, 903
See application file for complete search history.

(56) References Cited

U.S. PATENT DOCUMENTS 5,944,354 A * 8/1999 Feola ..... 283/67
2006/0119032 A1* 6/2006 Scrymgeour et al. ..... 273/138.1

FOREIGN PATENT DOCUMENTS

GB 2075918 A * 11/1981

* cited by examiner

*Primary Examiner*—Benjamin H Layno
(74) *Attorney, Agent, or Firm*—Dority & Manning, P.A.

(57) ABSTRACT

A lottery ticket including at least one game area with at least one play area where each play area includes a plurality of play regions with each play region having a first indicia covered by an opaque scratch-off layer and a second indicia appearing above the scratch-off layer. The player removes at least one of the scratch-off layers and if the first indicia appearing in such activated play regions matches any one of the second indicia in a non-activated play region, a prize may be won.

10 Claims, 2 Drawing Sheets

LOTTERY TICKET GAME

FIELD OF THE INVENTION

The present invention is directed to lottery tickets and particularly to a lottery ticket game in which each play area contains a plurality of play regions with each play region provided with play indicia appearing above and below an opaque scratch-off layer. The play indicia are not the same (i.e. the play indicia below the scratch-off layer is not the same as the play indicia appearing above the scratch-off layer in the same play region). At least one of the play regions has the scratch-off layer removed to reveal the play indicia appearing below the scratch-off layer which if matched with any one of the play indicia appearing above the scratch-off layer in another play region, a prize may be won.

BACKGROUND OF THE INVENTION

Scratch-off lottery tickets have become increasingly popular with the purchasing public. Early scratch-off lottery tickets were principally concerned with providing an opportunity to win a prize for the purchaser. However, in recent years, there has been a concerted effort on part of lottery ticket designers and government lottery agencies to provide scratch-off lottery tickets that also provide games that can be played by the purchaser. These games provide a form of amusement and encourage lottery ticket sales. One such type of lottery ticket is a bingo-type lottery ticket as disclosed in Reissue Pat. No. 34,673, incorporated herein by reference. This ticket provides a bingo game and includes a marking system whereby each play region has a bingo number printed thereon covered by a scratch-off layer with the same number printed above the scratch-off layer. When the player is entitled to play a particular play region having a bingo number obtained from a calling card, the player removes the scratch-off layer and reveals the same bingo number below the scratch-off layer which has a contrasting appearance to the same number appearing above the scratch-off layer. This marking system helps the player identify which bingo numbers have been played on the player's card.

It would be an advantage in the art of producing lottery tickets to provide a new game format in which the technology of printing on an opaque scratch-off layer could be used, not to mark or identify a number that has been played, but to generate a new type of lottery game by matching play indicia in one play region with play indicia in another play region.

SUMMARY OF THE INVENTION

The present invention is therefore directed to a lottery ticket in which a game area is provided including at least one play area. Each play area is provided with play regions each having a play indicia printed above and below an opaque scratch-off layer as hereinafter defined. In accordance with the instructions of the game, the player removes the scratch-off layer from at least one of the play regions and thereby removes the play indicia appearing above the scratch-off layer and observes a different play indicia below the scratch-off layer from the play indicia appearing above the scratch-off layer. If the play indicia below the scratch-off layer matches any one of the play indicia appearing above the remaining scratch-off layers of the other play regions (i.e. the scratch-off layers that have not been removed), a prize may be awarded.

In a particular aspect of the present invention, there is provided a lottery ticket comprising at least one game area comprising at least one play area, each play area comprising a plurality of play regions with each play region comprising a first indicia, a first opaque scratch-off layer covering the first indicia, and a second indicia appearing above the scratch-off layer, said second indicia being different than the first indicia, and prize determining means comprising instructions for removing the scratch-off layer from at least one of the play regions to form an activated play region, wherein a prize is won if the first indicia in at least one activated play region matches a second play indicia remaining in the play regions which are not activated (i.e. non-activated play regions).

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is generally directed to a lottery ticket having at least one game area which includes at least one play area. Each play area comprises a plurality of play regions with each play region comprising a first indicia as defined herein covered by a first opaque scratch-off layer. Thus, the first indicia appears below the first opaque scratch-off layer and is hidden therefrom at the start of the game. There is a second indicia appearing above the scratch-off layer of each play region. The second indicia is different than the first indicia.

As used herein the term "above the opaque scratch-off layer" or similar term shall mean that the second indicia is printed directly on the scratch-off layer or on an intermediary layer which is applied directly or indirectly on the scratch-off layer. For example, the second indicia may be printed on a varnish layer which is directly applied to the scratch-off layer multiple intermediary layers may be printed on the scratch-off layer before applying the second indicia.

Similarly, the term "below the opaque scratch-off layer" or similar term shall mean that the opaque scratch-off layer is printed directly on the first indicia or one or more intermediary layers such as a varnish layer are provided between the first indicia and the opaque scratch-off layer. The selection of suitable intermediary layers for printing the first and second indicia is routine and would be known to those of ordinary skill in the art.

The lottery ticket also comprises a prize determining means with instructions for removing the scratch-off layer from at least one of the play regions to form an activated play region in which the first indicia is exposed because the scratch-off layer has been removed. If the first indicia in an activated play region matches any one of the second play indicia appearing in a play region which has not been activated within the same play area, then a prize may be won. Thus, the game is played by matching first indicia from one or more activated play regions with second play indicia from non-activated play regions within a single play area.

Figure 1:
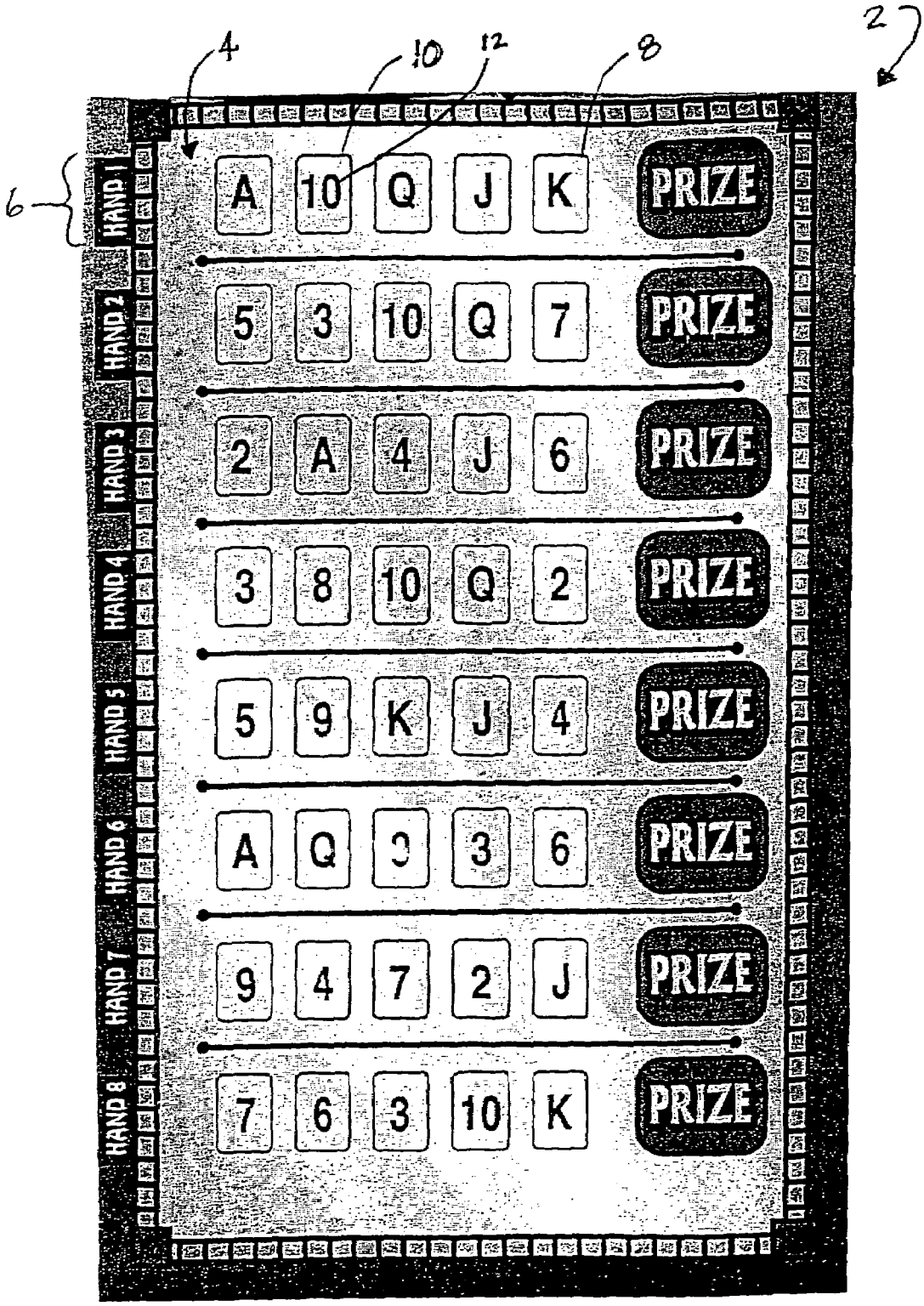
FIG. 1 is a front view of a lottery ticket in accordance with the present invention showing a game area containing eight play areas each containing five play regions.

Referring to FIG. 1, there is shown an embodiment of the lottery ticket of the present invention designated by the numeral 2 having a game area 4. The game area 4 contains at least one play area 6. As shown in FIG. 1, the game area 4 includes eight play areas 6, identified by the legend "HAND 1, HAND 2, etc.

Each play area contains a plurality of play regions 8. As shown in FIG. 1, each play area 6 is in the form of a row and is provided with five individual play regions 8 each in the form of a box which are aligned in the form of a row. It will be understood that the size and design of the play areas 6 and the play regions 8 need not be in the form of a row of individual boxes as shown in FIG. 1. The play areas 6 can assume any geometrical shape such as a circle, polygon and the like as can the individual play regions 8.

Each play region is shown in FIG. 1 with a scratch-off layer 10 having printed thereon a second play indicia 12. The first play indicia will appear below the scratch-off layer 10 and will be described in connection with FIG. 2. The game is played in accordance with the instructions provided by the lottery sponsor, by removing the scratch-off layer in at least one but not all of the play regions 8.

Figure 2:
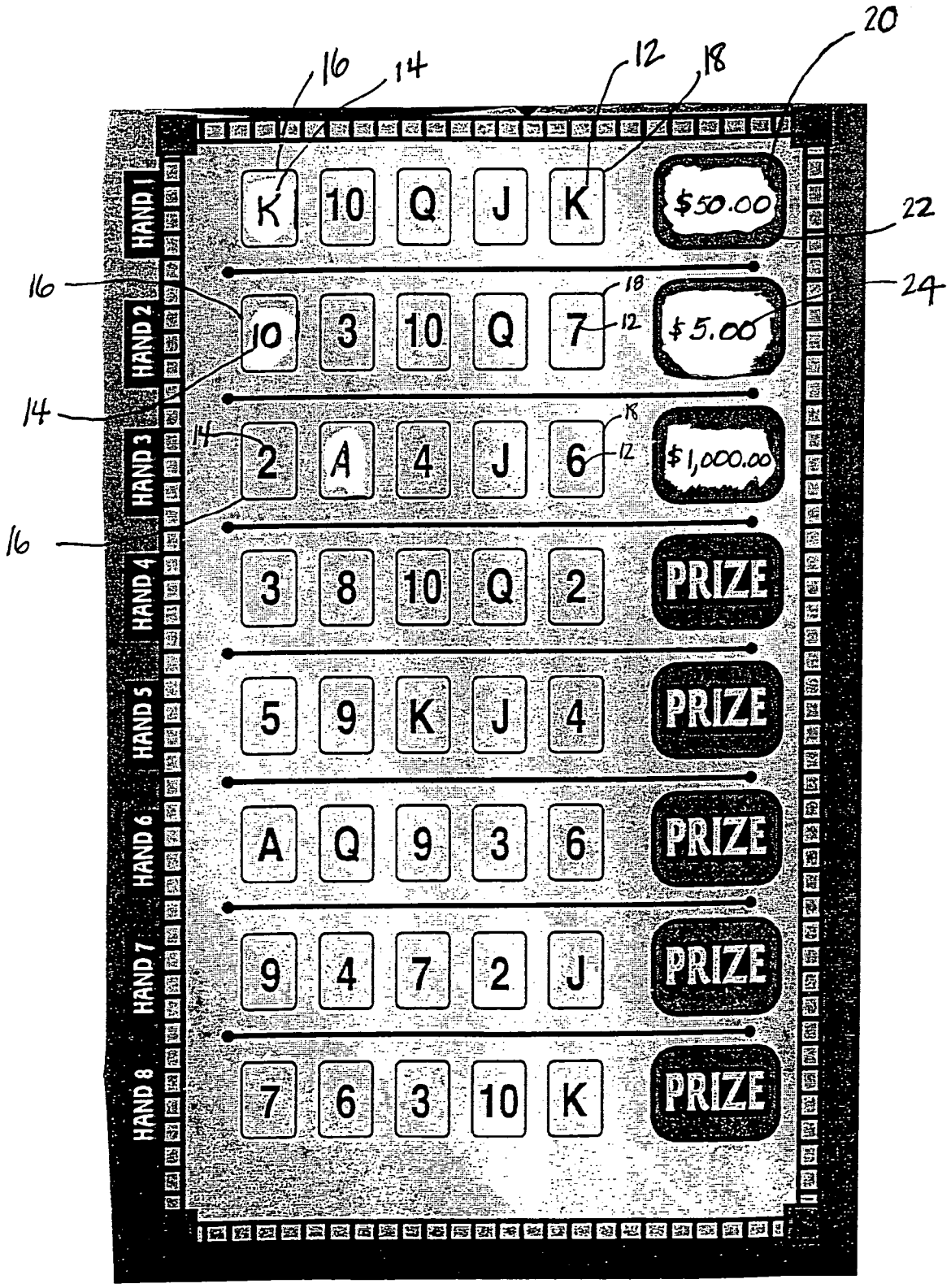
FIG. 2 is a front view of the lottery ticket shown in FIG. 1 with several of the play areas having a single play region activated.

Referring to FIG. 1, the first play area 6 designated by the words "HAND 1" shows five play regions 8 having second play indicia A, 10, Q, J and K in each of the respective play regions 8 moving from left to right. In one of the embodiments of the invention, the prize determining means includes instructions for removing the scratch-off layer from one of the play regions 8. As shown in FIG. 2, the scratch-off layer having the play indicia "A" appearing thereon is removed from the play region appearing on the far left. Appearing below the scratch-off layer 10 of the same play region is a first play indicia 14 represented by the play indicia "K". The removal of the scratch-off layer 10 designates this play region as an activated play region. Because the first play indicia 14 ("K") appearing in the activated play region 16 matches one of the second play indicia 12 appearing in a non-activated play region 18 (i.e. the play region appearing in the left hand most position of the play area 6), there is a match and a prize may be won. Thus, the object of the game is to match a first play indicia 14 appearing in an activated play region 16 (i.e. below the scratch-off layer 10 which has been removed) with a second play indicia 12 appearing above the scratch-off layer 10 of one of the non-activated play regions 18 (i.e. a play region 8 where the scratch-off layer has not been removed).

Referring again to FIGS. 1 and 2, the second of the play areas 6 ("HAND 2") shows that a play region containing the second play indicia ("5") has been activated to reveal a first play indicia ("10") which has now become an activated play region 16. Since the first play indicia 14 ("10") of the activated play region 16 matches the second play indicia 12 appearing in the third play region (a non-activated play region 18), a prize may be rewarded.

Once again referring to FIG. 2, the third play area ("HAND 3") shows an activated play region 16 with the second play indicia 14 ("A") being revealed which does not match the first play indicia appearing in any of the non-activated play regions 18. Since there is no match, this particular play area 6 does not produce the possibility of winning a prize.

The lottery ticket 2 of the present invention may have multiple game areas 4 as previously described. The number of play areas 6 which appear in each game area 4 is limited only by the available space appearing on the lottery ticket. The number of play regions 8 appearing in each play area 6 is likewise unlimited but is preferably in the range of four to eight.

The first play indicia 14 and the second play indicia 12 can include a wide range of symbols. As shown in FIGS. 1 and 2, the first and second play indicia are the individual cards of a standard deck of cards. However, the first and second play indicia can include any symbols, numbers, letters, pictures, portraits, designs, geometric shapes, colors, and the like so long as the player can visually observe a match between the first play indicia 14 of an activated play region 16 and the second play indicia 12 of a non-activated play region 18.

It will also be appreciated that the first and second play indicia may comprise multiple symbols. By way of example, the first and second play indicia may be the playing cards of a standard deck of cards (e.g. "A") as well as one of the suits of a playing card (e.g. a heart) to form a multiple symbol play indicia (e.g. Ace of hearts).

The lottery ticket of the present invention includes an optional prize designation area in which the player can immediately know the amount of the prize that will be awarded for a match. As shown in FIG. 2, a prize designation area 20 is shown adjacent each play area 6. The prize designation area 20 may be covered by a scratch-off layer 22 as shown in FIG. 1 which as shown in FIG. 2, has been partially removed from the first three play areas to reveal prize amounts 24.

What is claimed is:

1. A lottery ticket comprising: a substrate;

at least one game area comprising at least one play area on top of said substrate, each play area comprising a plurality of play regions with each play region comprising a first indicia, a visible first opaque scratch-off layer covering the first indicia and a second indicia printed on top of the scratch-off layer, said second indicia being different than the first indicia in each play region, and in each play area at least one first indicia matching at least one second indicia within the same play area, and prize determining means comprising instructions for removing the first opaque scratch-off layer from at least one of the play regions to form an activated play revealing the first indicia beneath the scratch-off layer, region wherein a prize is won if the first indicia in at least one activated play region matches any one of the second play indicia remaining in the play regions which are not activated.

2. The lottery ticket of claim 1 comprising a plurality of play areas.

3. The lottery ticket of claim 1 wherein each play area comprises at least three play regions.

4. The lottery ticket of claim 1 wherein the first and second indicia comprise a single symbol.

5. The lottery ticket of claims 1 wherein the first and second indicia each comprise at least two symbols.

6. The lottery ticket of claim 1 wherein the prize determining means comprises removing the scratch-off layer from a single play region.

7. The lottery ticket of claim 1 wherein the prize determining means comprises removing the scratch-off layer from a plurality of play regions.

8. The lottery ticket of claim 1 further comprising a prize designation area associated with each play area.

9. The lottery ticket of claim 8 wherein the prize designation area comprises a prize amount covered by a second opaque scratch-off layer.

10. The lottery ticket of claim 1 comprising at least three play areas, each play area comprising five play regions.

* * * * *